US006587663B2

(12) United States Patent
Ishizuka

(10) Patent No.: US 6,587,663 B2
(45) Date of Patent: Jul. 1, 2003

(54) RELEASING AGENT APPLYING APPARATUS HAVING CLEANING MEMBER

(75) Inventor: Jiro Ishizuka, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/945,729

(22) Filed: Sep. 5, 2001

(65) Prior Publication Data

US 2002/0029739 A1 Mar. 14, 2002

(30) Foreign Application Priority Data

Sep. 11, 2000 (JP) ..... 2000-274886

(51) Int. Cl.[7] ..... G03G 15/20
(52) U.S. Cl. ..... 399/325; 118/60
(58) Field of Search ..... 399/324–326; 118/60

(56) References Cited

U.S. PATENT DOCUMENTS

| | | | | |
|---|---|---|---|---|
| 5,463,457 A | | 10/1995 | Takeuchi et al. | |
| 5,563,695 A | | 10/1996 | Sakurai et al. | |
| 5,634,184 A | * | 5/1997 | Dalal et al. | 399/325 |
| 5,839,041 A | * | 11/1998 | Condello et al. | 399/325 |
| 6,088,546 A | | 7/2000 | Inoue et al. | 399/45 |
| 6,219,520 B1 | * | 4/2001 | Ehara | 399/325 |
| 6,272,307 B1 | | 8/2001 | Ishizuka et al. | 399/325 |

* cited by examiner

*Primary Examiner*—William J. Royer
(74) *Attorney, Agent, or Firm*—Fitzpatrick, Cella, Harper & Scinto

(57) ABSTRACT

A releasing agent applying apparatus having an applying rotatable member for applying a releasing agent to an applied member, a supplying member for supplying the releasing agent to the applying rotatable member, a regulating member for regulating an amount of the releasing agent on the applying rotatable member, and a cleaning member for cleaning a surface of the applying rotatable member.

7 Claims, 5 Drawing Sheets

FIG. 4

| | OIL STREAK OCCURRENCE | FIXING ROLLER LIFE |
|---|---|---|
| WITHOUT CLEANING BLADE | ABOUT 20000 SHEETS | ABOUT 60000 SHEETS |
| WITH CLEANING BLADE | ABOUT 40000 SHEETS | ABOUT 80000 SHEETS |

FIG. 5

| CLEANING BLADE | REGULATING BLADE | OIL STREAK OCCURRENCE |
|---|---|---|
| FLUORORUBBER | FLUORORUBBER | ABOUT 40000 SHEETS |
| FLUORORUBBER | SILICONE RUBBER | ABOUT 60000 SHEETS |

RELEASING AGENT APPLYING APPARATUS HAVING CLEANING MEMBER

BACKGROUND OF THE INVENTION

1. Field of the Invention

The present invention relates to a releasing agent applying apparatus for preferable use in a fixing apparatus of an image forming apparatus such as a copying machine or a printer and for applying a releasing agent to a fixing roller or the like.

2. Related Background Art

Referring to FIG. 6, there is shown a cross section of a fixing apparatus having an oil applying mechanism.

As shown in FIG. 6, the fixing apparatus comprises a fixing roller 151 which is a rotatably arranged fixing member, a pressing roller 152 which is a pressing member rotating being press-contacted with the fixing roller 151, a releasing agent applying apparatus 153 which is a releasability imparting apparatus, and roller cleaning apparatuses 154 and 155.

There are arranged heaters 156 and 157 such as halogen lamps inside the fixing roller 151 and the pressing roller 152, respectively. In addition, thermistors 158 and 159 are arranged for the fixing roller 151 and the pressing roller 152 so as to be in contact therewith, respectively, thereby regulating temperatures of surfaces of the fixing roller 151 and the pressing roller 152 by controlling voltages to the heaters 156 and 157 via a temperature regulation circuit (not shown).

Additionally, the fixing roller 151 is provided with the cleaning apparatus 154 and the releasing agent applying apparatus 153. The cleaning apparatus 154 cleans offset toner on the fixing roller 151 and the releasing agent applying apparatus 153 applies silicone oil which is a releasing agent to the fixing roller 151, thus facilitating a separation of a transfer paper P which is a recording material from the fixing roller 151 and preventing toner offset.

The cleaning apparatus 154 comprises a cleaning web 154*a* made of a belt-shaped heat-resistant nonwoven fabric, a pushing roller 154*b* for pushing the cleaning web 154*a* against the fixing roller 151, an unwinding roller 154*c* for unwinding a new cleaning web 154*a*, and a winding roller 154*d* for gradually winding up the cleaning web 154*a* having a deteriorated cleaning performance due to adhering toner. Particularly to prevent a detection failure on the thermistor 158 caused by adhering offset toner on the thermistor 158, the cleaning apparatus 154 is arranged upstream of a rotary direction of the fixing roller 151 relative to the thermistor 158.

Describing a method of winding up the cleaning web 154*a*, a solenoid (not shown) is turned on and a one-way clutch (not shown) operates when it is determined that copies have been made by a predetermined number of sheets on the basis of a counter (not shown), by which the cleaning web is wound up by a predetermined amount in a reverse direction to the rotary direction of the fixing roller 151. The winding-up in the reverse direction prevents the cleaning web 154*a* from being wound up in the above rotary direction.

The releasing agent applying apparatus 153 comprises an oil pan 153*a* which is a storage member for storing a releasing agent such as silicone oil, rollers 153*b* and 153*c* which are releasing agent supplying members for scooping up oil which is a releasing agent from the oil pan 153*a*, an applying roller 153*d* which is a releasing agent applying member for applying oil from the scooping rollers 153*b* and 153*c* to the fixing roller 151, and a regulating blade 153*e* which is a releasing agent regulating member for regulating an amount of the applied oil from the applying roller 153*d*.

Particularly to apply oil uniformly to the fixing roller 151, the releasing agent applying apparatus 153 is arranged downstream of the rotary direction of the fixing roller 151 relative to the thermistor 158. The applying roller 153*d* is a rotatable roller coated with silicone rubber on its surface made of sponge rubber, abutting the fixing roller 151 for applying the oil. The regulating blade 153*e* is an elastic blade made of fluororubber or the like for regulating an amount of applied oil by an abutting angle, an abutting pressure, or the like.

In addition, the pressing roller 152 is provided with a cleaning apparatus 155 comprising a cleaning web 155*a*, a pushing roller 155*c*, an unwinding roller 155*b*, a winding roller 155*d* and the like in the same manner as for the cleaning apparatus 154 for the fixing roller 151, so as to clean toner adhering to the pressing roller 152 via the fixing roller 151.

Furthermore, there is an oil removing blade 160 which is a releasing agent removing elastic member for removing a surplus releasing agent remaining on the pressing roller 152, abutting the pressing roller 152. Without this oil removing blade 160, the surplus releasing agent is stagnant in a nip between the fixing roller 151 and the pressing roller 152, thereby staining a transfer paper or causing an approaching failure to the nip due to a slippage of an OHP transparent laminate film. As materials for the oil removing blade 160, there can be used silicone rubber, fluororubber and the like. The blade abuts the pressing roller 152 by an appropriate approaching amount in a forward or backward direction relative to the rotary direction of the pressing roller 152.

If a transfer paper P is a conveyed in this condition, the fixing roller 151 and the pressing roller 152 rotate, a silicone oil is applied to the fixing roller 151 on its surface as a releasing agent, the transfer paper P is pressed and heated at almost constant pressure and temperature in both directions from the outside of the front and rear surfaces when passing between the fixing roller 151 and the pressing roller 152, by which an unfixed toner image on the surface of the transfer paper P is fluxed and fixed and then a full-color image is formed on the transfer paper P. The image-fixed transfer paper P is separated from the pressing roller 152 by a lower separation claw (not shown) and then ejected to an outside of the apparatus.

In the conventional releasability imparting apparatus such as the above releasing agent applying apparatus 153, however, there is a disadvantage that it may cause the following problem.

In the releasing agent applying apparatus 153, the amount of oil applied to the fixing roller 151 is suppressed by the regulating blade 153*e* to a predetermined amount. As the number of sheets to be processed increases, the regulating blade 153*e* is stained by offset toner or paper dust.

Then, if this kind of dust adheres to an edge portion of the regulating blade 153*e* where the regulating blade 153*e* abuts the applying roller 153*d*, only a portion cannot be submitted to the oil amount regulation on the fixing roller 151, thereby causing oil to slip through the regulating blade 153*e*.

This causes an oil streak for an OHP or for an image having a large amount of toner, which may lead to quality degradation.

SUMMARY OF THE INVENTION

It is an object of the present invention to provide a releasing agent applying apparatus which prevents toner, paper dust or the like from adhering to a releasing agent regulating member.

It is another object of the present invention to provide a releasing agent applying apparatus which enables a releasing agent to be uniformly applied.

It is still another object of the present invention to provide a releasing agent applying apparatus which comprises an applying rotator for applying a releasing agent to an applied member, a supplying member for supplying a releasing agent to the applying rotator, a regulating member for regulating an amount of a releasing agent on the applying rotator, and a cleaning member for cleaning a surface of the applying rotator.

Other objects of the present invention besides those discussed above shall be apparent to those skilled in the art from the description of preferred embodiments of the invention which follows.

BRIEF DESCRIPTION OF THE DRAWINGS

FIG. 4 is a table showing a result of comparing an oil streak occurrence and a fixing roller life in a first embodiment of the present invention with conventional ones;

FIG. 5 is a table showing a result of comparing an oil streak occurrence and a fixing roller life in a second embodiment of the present invention with those in the first embodiment.

DETAILED DESCRIPTION OF THE PREFERRED EMBODIMENTS

The preferred embodiments of the present invention will now be described in detail hereinafter with reference to the accompanying drawings.

First Embodiment

A first embodiment of the present invention will be descried by referring to FIG. 1 to FIG. 4.

Figure 1:
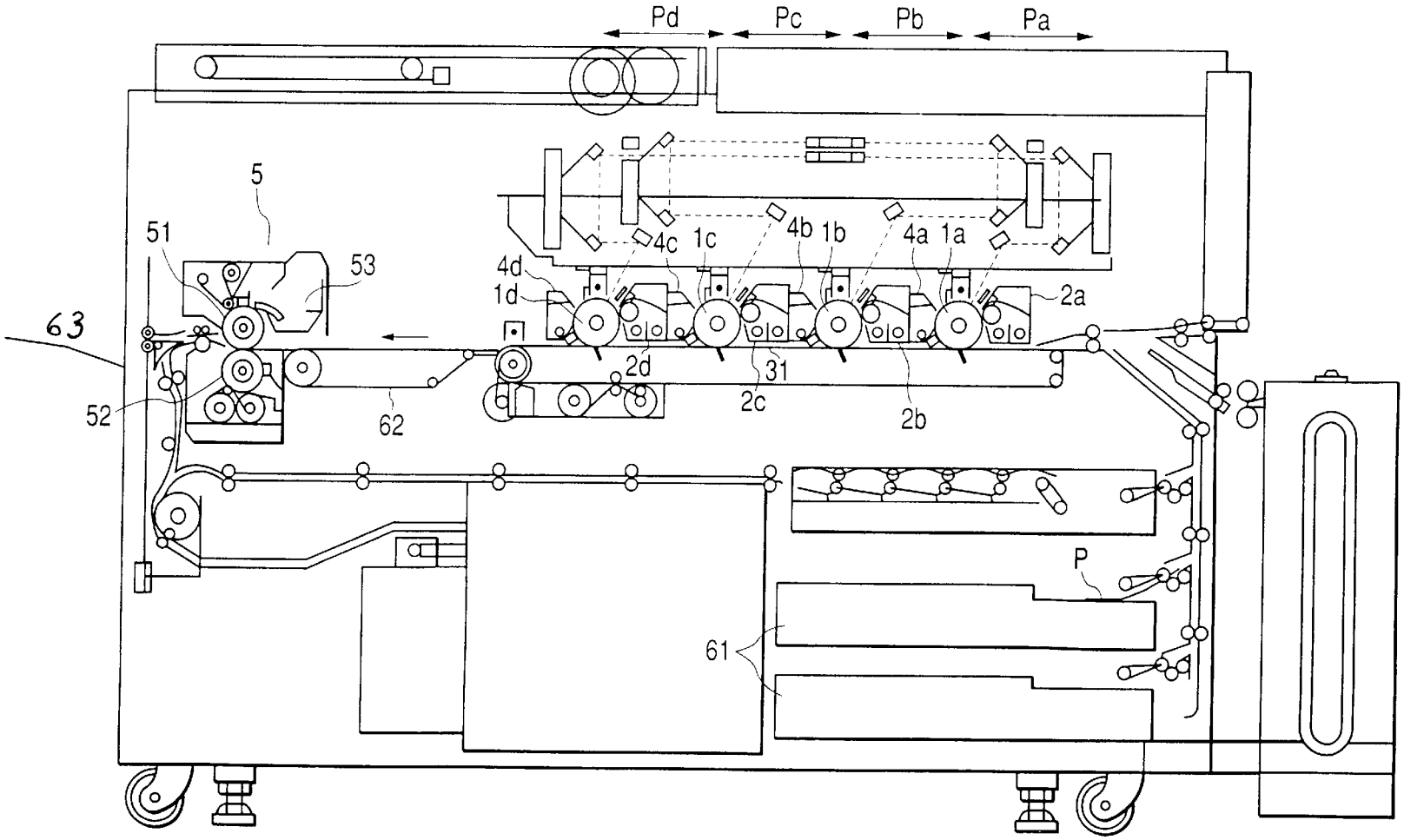
FIG. 1 is a cross section showing a schematic configuration of an image forming apparatus according to a first embodiment of the present invention.
Figure 2:
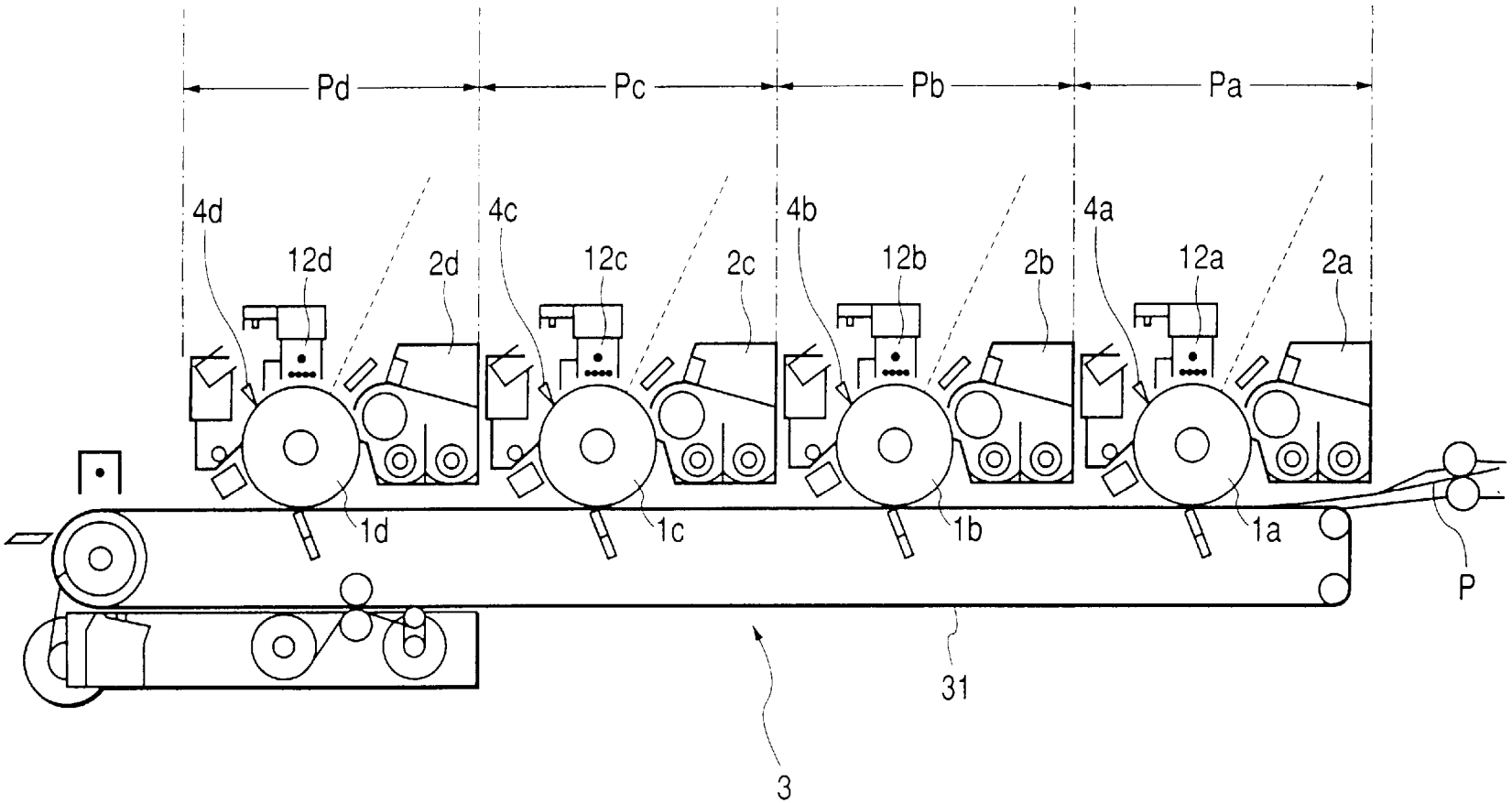
FIG. 2 is an enlarged view of an image forming portion of the image forming apparatus shown in FIG. 1.

As an example of an image forming apparatus according to this embodiment, a 4-drum laser beam printer (hereinafter, referred to as a printer) having a plurality of optical scanners is shown in FIG. 1 and FIG. 2.

The printer, as shown in FIG. 1, has image forming stations Pa, Pb, Pc, and Pd which are four image forming members having developing apparatuses 2*a*, 2*b*, 2*c*, and 2*d* around electrophotographic photosensitive members (hereinafter, referred to as photosensitive drums) 1*a*, 1*b*, 1*c*, and 1*d* which are latent image bearing members and has a configuration in which images formed on the photosensitive drums 1*a*, 1*b*, 1*c*, and 1*d* in the respective image forming stations are transferred to a transfer paper P which is a recording material such as a paper on a transfer belt 31 which is a recording material conveying member adjacently moving and passing the photosensitive drums 1*a*, 1*b*, 1*c* and 1*d*.

As shown in FIG. 2, the image forming stations Pa, Pb, Pc, and Pd for forming images of magenta, cyan, yellow, and black colors have the photosensitive drums 1*a*, 1*b*, 1*c*, and 1*d*, respectively, and the photosensitive drums are rotatable. Furthermore, around the photosensitive drums 1*a*, 1*b*, 1*c*, and 1*d*, electrifiers 12*a*, 12*b*, 12*c*, and 12*d*, developing apparatuses 2*a*, 2*b*, 2*c*, 2*d*, and cleaners 4*a*, 4*b*, 4*c*, and 4*d* are sequentially arranged in a rotary direction of the photosensitive drums, and a transfer portion 3 is arranged under the photosensitive drums. The transfer portion 3 has the transfer belt 31 which is a recording material conveying member common to the image forming stations.

In the above printer, the transfer paper P supplied from a sheet feeding cassette 61 which is a recording material supplying member shown in FIG. 1 is supported on the transfer belt 31 and conveyed to the respective image forming stations, where toner images of the respective colors formed on the photosensitive drums are sequentially transferred to the paper. When this transferring process is completed, the above transfer paper P is separated from the transfer belt 31 and then conveyed to the fixing apparatus 5 by a conveying belt 62 which is a recording material guiding member.

Then, the above transfer paper P is heated or pressed by the fixing apparatus 5, by which the above toner is fixed to the transfer paper P, and then it is ejected to the outside of the apparatus.

Next, the fixing apparatus 5 will be described in detail below.

Figure 3:
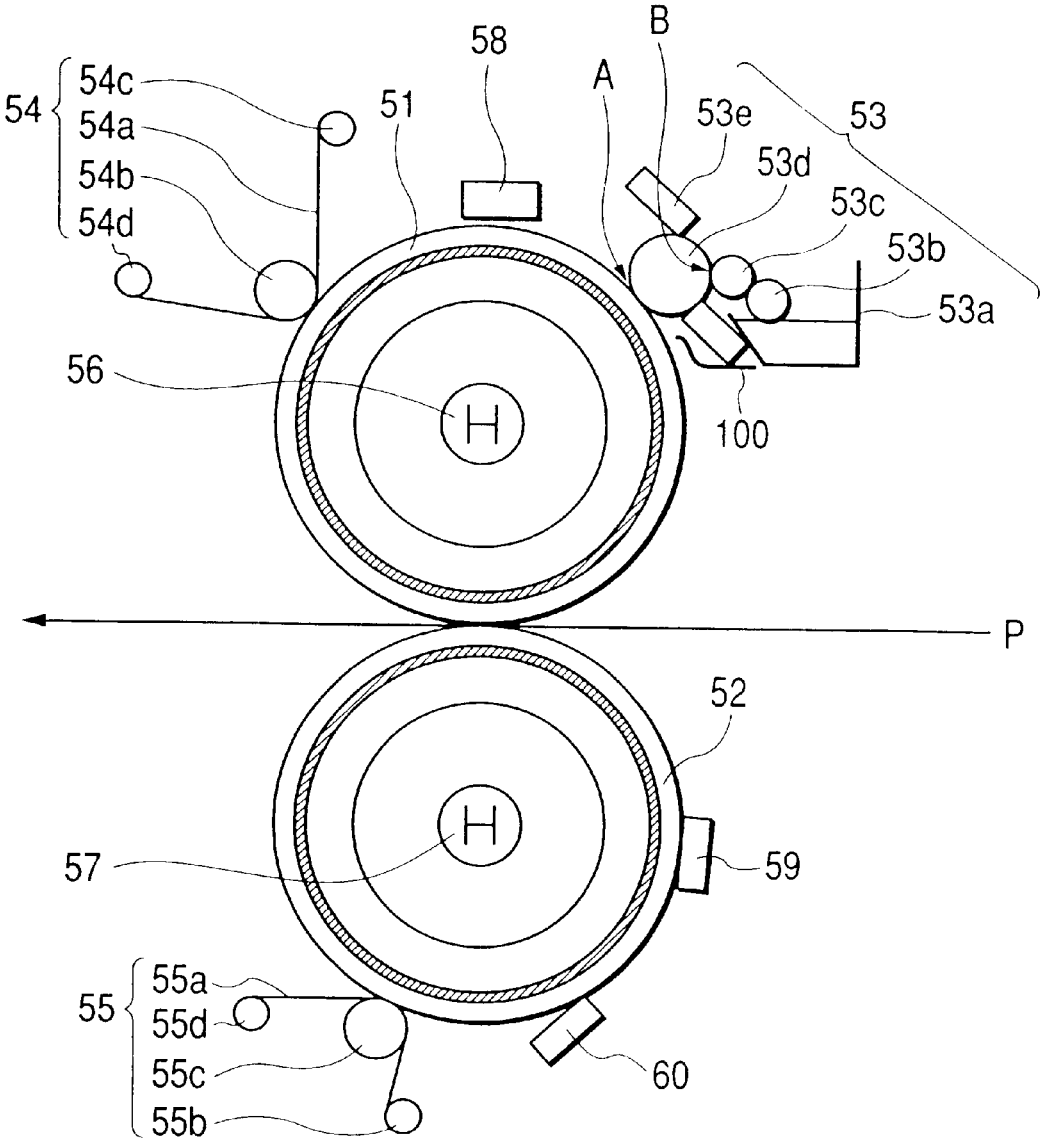
FIG. 3 is a schematic cross section showing a schematic configuration of a fixing apparatus arranged in the image forming apparatus shown in FIG. 1.

Referring to FIG. 3, there is shown a cross section illustrating a schematic configuration of the fixing apparatus 5.

As shown in FIG. 3, the fixing apparatus 5 comprises a fixing roller 51 which is a rotatably arranged fixing member, a pressing roller 52 which is a pressing member rotating while being press-contacted with the fixing roller 51, a releasing agent applying apparatus 53 which is a releasability imparting apparatus, and roller cleaning apparatuses 54 and 55.

The fixing roller 51 and pressing roller 52 contain heaters 56 and 57 such as halogen lamps, respectively. For the fixing roller 51 and the pressing roller 52, thermistors 58 and 59 are arranged so as to be put in contact therewith. Temperatures of surfaces of the fixing roller 51 and the pressing roller 52 are regulated by controlling voltages to the heaters 56 and 57 via a temperature regulation circuit (not shown).

In addition, the fixing roller 51 is provided with the cleaning apparatus 54 and the releasing agent applying apparatus 53; the cleaning apparatus 54 cleans offset toner or the like on the fixing roller 51 and the releasing agent applying apparatus 53 applies silicone oil which is a releasing agent to the fixing roller 51 so as to facilitate a separation of a transfer paper P which is a recording material from the fixing roller 51 and to prevent toner offset.

The cleaning apparatus 54 comprises a cleaning web 54*a* made of a belt-shaped heat-resistant nonwoven fabric, a pushing roller 54*b* for pushing the cleaning web 54*a* against the fixing roller 51, an unwinding roller 54*c* for unwinding a new cleaning web 54*a*, and a winding roller 54*d* for gradually winding up the cleaning web 54*a* having a deteriorated cleaning performance due to adhering toner. Particularly to prevent a detection failure on the thermistor 58 caused by adhering offset toner on the thermistor 58, the cleaning apparatus 54 is arranged upstream of a rotary direction of the fixing roller 51 relative to the thermistor 58.

Describing a method of winding up the cleaning web 54*a*, a solenoid (not shown) is turned on and a one-way clutch (not shown) operates when it is determined that copies have been made by a predetermined number of sheets on the basis of a counter (not shown), by which the cleaning web is wound up by a predetermined amount in a reverse direction to the rotary direction of the fixing roller 51. The winding-up in the reverse direction prevents the cleaning web 54*a* from being wound up in the above rotary direction.

In addition, the pressing roller 52 is provided with a cleaning apparatus 55 comprising a cleaning web 55*a*, a pushing roller 55*c*, an unwinding roller 55*b*, a winding roller 55*d* and the like in the same manner as for the cleaning apparatus 54 for the fixing roller 51, so as to clean toner adhering to the pressing roller 52 via the fixing roller 51.

Furthermore, there is an oil removing blade 60 which is a releasing agent removing elastic member for removing a surplus releasing agent remaining on the pressing roller 52, abutting against the pressing roller 52. Without this oil removing blade 60, the surplus releasing agent is stagnant in a nip between the fixing roller 51 and the pressing roller 52, thereby staining a transfer paper or causing an approaching failure to the nip due to a slippage of an OHP transparent laminate film. As materials for the oil removing blade 60, silicone rubber, fluororubber and the like are used. The blades abut against the pressing roller 52 by an appropriate approaching amount in a forward or backward direction relative to the rotary direction of the pressing roller 52.

If a transfer paper P is conveyed in this condition, the fixing roller 51 and the pressing roller 52 rotate, silicone oil is applied to the fixing roller 51 on its surface as a releasing agent, the transfer paper P is pressed and heated at almost constant pressure and temperature in both directions from the outside of the front and rear surfaces when passing between the fixing roller 51 and the pressing roller 52, by which an unfixed toner image on the surface of the transfer paper P is fluxed and fixed and then a full-color image is formed on the transfer paper P. The image-fixed transfer paper P is separated from the pressing roller 52 by a lower separation claw (not shown) and then ejected to the outside of the apparatus.

The releasing agent applying apparatus 53 will be described in detail below.

As shown in FIG. 3, the releasing agent applying apparatus 53 of this embodiment comprises an oil pan 53*a* which is a storage member for storing a releasing agent such as silicone oil, scooping rollers 53*b* and 53*c* which are supplying members and may serve as supplying means for scooping up oil which is a releasing agent from the oil pan 53*a*, an applying roller 53*d* which is a releasing agent applying rotatable member for applying oil supplied from the oil pan 53 via the scooping rollers 53*b* and 53*c* to the fixing roller 51, a regulating blade 53*e* which is a releasing agent regulating member for regulating an amount of the applied oil from the applying roller 53*d*, and a cleaning blade 100 which is a cleaning member arranged abutting the surface of the applying roller 53*d*. Particularly to apply oil uniformly to the fixing roller 51, the releasing agent applying apparatus 43 is arranged downstream of the rotary direction of the fixing roller 51 relative to the thermistor 58. The applying roller 53*d* is a rotatable roller coated with silicone on its surface made of sponge rubber, abutting against the fixing roller 51 to apply the oil. The regulating blade 53*e* is an elastic blade made of fluororubber or the like which appropriately regulates an amount of applied oil by presetting an abutting angle, an abutting pressure or the like.

The cleaning blade 100 is used for cleaning toner or paper dust which has offset to the fixing roller 51 and further shifted to the applying roller 53*d*.

Although there can be a nonwoven fabric or a felt as a cleaning member other than the above blade, they are inappropriate because of a problem that fibers may fall out, thereby causing oil streaks due to the fibers adhering to an edge of the regulating blade 53*e*. Therefore, an optimum cleaning member is a metal blade or a rubber or other elastic blade free from fiber fallout.

As an abutting position of the cleaning blade 100 against the applying roller 53*d*, assuming that A designates an abutting nip A between the fixing roller 51 and the applying roller 53*d* and B designates an abutting nip between the applying roller 53*d* and the scooping roller 53*b*, the applying roller 53*d* needs to abut against A, the cleaning blade 100, B, the regulating blade 53*e*, and A in this order relative to the rotary direction of the applying roller 53*d*. It is because, if the roller abuts against A, B, the cleaning blade 100, the regulating blade 53*e*, and A in this order, for example, an oil streak may occur on the applying roller 53*d* due to toner or paper dust adhering to the cleaning blade 100 and they may remain as a streak since they cannot be regulated by the regulating blade 53*e*.

In order to prevent it, B must be present between the cleaning blade 100 and the regulating blade 53*e* relative to the rotary direction of the applying roller 53*d*. This arrangement cancels an oil streak even if the oil streak occurs in the cleaning blade 100 since a large amount of oil is uniformly scooped up to the applying roller 53*d* at B. Then, the oil is regulated by the regulating blade 53*e* having no adhering toner and no paper dust in the downstream, thereby preventing an occurrence of oil streaks.

As for the abutting direction of the cleaning blade 100, preferably the cleaning blade 100 abuts the applying roller 53*d* in the counter direction to the rotary direction of the applying roller 53*d*. It is because a regulating force in the counter direction is larger than that in the forward direction, thereby increasing a scraping force of toner and paper dust.

Furthermore, preferably the cleaning blade 100 is arranged outside the oil pan 53*a* and the collected dust or the like is guided to the outside of the oil pan 53*a*. The cleaning blade 100 cleans toner or paper dust on the applying roller 53*d*, and therefore if the toner or paper dust scraped here returns to an inside of the oil pan 53*a*, the oil in the oil pan 53*a* stains. If this stained oil is applied to the fixing roller 51, releasability of the fixing roller 51 is lowered in comparison with a case that fresh oil is applied.

In this embodiment, the cleaning blade 100 abuts in the abutting position as set forth in the above. The cleaning blade 100 is an elastic blade made of fluororubber, abutting at an angle of 30 deg to a tangent of the regulating blade 53*e* and at 1000 g of a total pressure in the counter direction. The regulating blade 53*e* is a fluororubber blade having the same material as for the cleaning blade 100 and being installed under the same conditions of an abutting angle, a pressure and the like as for the blade 100.

Figure 6:
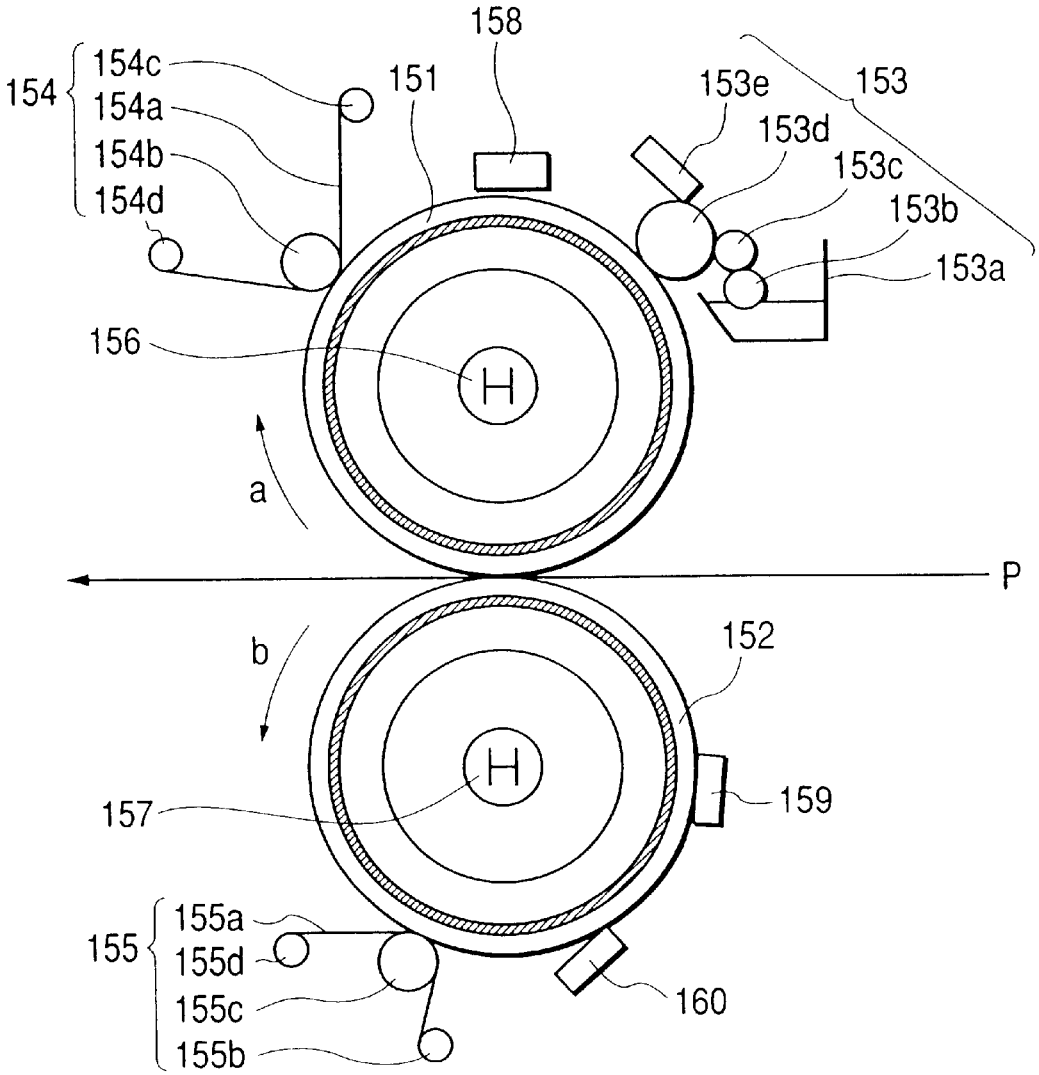
FIG. 6 PRIOR ART
FIG. 6 is a schematic cross section showing a schematic configuration of a fixing apparatus.

At this point, there is shown in FIG. 4 a result of a comparison with an apparatus without any cleaning blade 100 as shown in FIG. 6 regarding an oil streak occurrence and a fixing roller life according to this embodiment.

As shown in FIG. 4, while about 20,000 sheets are copied until an oil streak occurrence caused by the stained oil regulating blade in the apparatus without the cleaning blade 100 abutting against the roller shown in FIG. 6, the number of sheets copied until an oil streak occurrence increases up to about 40,000 sheets which is doubled by causing the cleaning blade 100 to abut against the roller under the same conditions in this embodiment.

In addition, while the cleaning blade 100 is stained with adhering toner and paper dust, the cleaning returns the blade to the initial condition and therefore it can be repeatedly used.

Furthermore, under the condition without the cleaning blade 100, toner and paper dust accumulate in the oil pan, thereby staining the oil, by which releasability of the fixing roller is deteriorated after copying about 60,000 sheets, thereby causing an offset which means an end of the life.

On the other hand, in this embodiment the cleaning blade 100 abutting against the applying roller 53*d* prevents oil in the oil pan 53*a* from staining, thereby increasing the number of sheets up to about 80,000 copied until an offset occurrence on the fixing roller 51.

Second Embodiment

Next, a second embodiment of the present invention will be described below. The same components as for the first embodiment are designated by the same reference numerals to omit their descriptions.

In this embodiment, material of a regulating blade 53*e* has a lower surface energy than that of the cleaning blade 100. It is because more effect is achieved by using the cleaning blade 100 easily gathering toner and paper dust and the regulating blade 53*e* hard to gather them.

Concretely speaking about materials of respective blades, silicone rubber or a metallic or elastic material coated with fluorine resin is used for the regulating blade 53*e* and fluororubber or metal is used for the cleaning blade.

By using these materials, a stain amount of the regulating blade 53*e* further decreases in comparison with the first embodiment, thereby increasing the number of copies until an oil streak occurrence.

Concretely speaking, as shown in FIG. 5, while an oil streak occurs after copying 40,000 sheets when using fluororubber for both of the regulating blade 53*e* and the cleaning blade 100 in the first embodiment, there is no occurrence of an oil streak until copying about 60,000 sheets when using silicone rubber for the regulating blade 53*e* and fluororubber for the cleaning blade 100 in this embodiment.

In this embodiment, the silicone rubber without metal filler as reinforcer such as silica is used. Silicone rubber with metal filler has a larger surface energy and therefore silicone rubber without metal filler is preferable.

While the present invention has been described in connection with certain preferred embodiments, it is to be understood that the subject matter encompassed by the present invention is not limited to those specific embodiments. On the contrary, it is intended to include all alternatives, modifications, and equivalents as can be included within the spirit and scope of the following claims.

What is claimed is:

1. A releasing agent applying apparatus, comprising:

an applying rotatable member for applying a releasing agent to an applied member;

supplying means for supplying the releasing agent to said applying rotatable member;

a regulating member for regulating an amount of the releasing agent on said applying rotatable member; and a cleaning member for cleaning a surface of said applying rotatable member.

2. The apparatus according to claim 1, wherein said cleaning member cleans said applying rotatable member downstream of an applying position to said applied member and upstream of a supplying position of said supplying means in a rotary direction of said applying rotatable member.

3. The apparatus according to claim 1, wherein said supplying means has a storage member for storing the releasing agent and a material collected by said cleaning member is guided to a cleaner containing member arranged outside said storage member.

4. The apparatus according to claim 1, wherein said cleaning member has fluororubber in a portion put in contact with said applying rotatable member.

5. The apparatus according to claim 1, wherein said cleaning member has a metal plate abutting said applying rotatable member.

6. The apparatus according to claim 1, wherein a surface energy in the portion where said cleaning member abuts said applying rotatable member is larger than a surface energy in a portion where said regulating member abuts said applying rotatable member.

7. The apparatus according to claim 1, wherein said applied member is a fixing rotatable member for fixing a toner image on a recording material.

* * * * *

UNITED STATES PATENT AND TRADEMARK OFFICE

CERTIFICATE OF CORRECTION

PATENT NO. : 6,587,663 B2
DATED : July 1, 2003
INVENTOR(S) : Jiro Ishizuka

It is certified that error appears in the above-identified patent and that said Letters Patent is hereby corrected as shown below:

Column 2,
Line 34, "a" (2nd occurrence) should be deleted.

Column 3,
Line 47, "descried" should read -- described --.

Signed and Sealed this

Ninth Day of December, 2003

JAMES E. ROGAN
*Director of the United States Patent and Trademark Office*